US010287053B2

(12) United States Patent
Kekeba

(10) Patent No.: US 10,287,053 B2
(45) Date of Patent: May 14, 2019

(54) RECYCLE BOTTLE WITH SPLIT ABLE MAIN BODY

(71) Applicant: Elaryon Kekeba, Los Angeles, CA (US)

(72) Inventor: Elaryon Kekeba, Los Angeles, CA (US)

( * ) Notice: Subject to any disclaimer, the term of this patent is extended or adjusted under 35 U.S.C. 154(b) by 0 days.

(21) Appl. No.: 15/784,134

(22) Filed: Oct. 14, 2017

(65) Prior Publication Data

US 2018/0178946 A1 Jun. 28, 2018

Related U.S. Application Data

(60) Provisional application No. 62/439,264, filed on Dec. 27, 2016.

(51) Int. Cl.

| | |
|---|---|
| ***B65D 6/24*** | (2006.01) |
| ***B65D 8/00*** | (2006.01) |
| ***B65D 51/18*** | (2006.01) |
| ***B65D 47/14*** | (2006.01) |

(52) U.S. Cl.

CPC ..... *B65D 11/04* (2013.01); *B65D 11/1873* (2013.01); *B65D 47/14* (2013.01); *B65D 51/18* (2013.01); *B65D 2251/0018* (2013.01); *B65D 2251/0025* (2013.01); *B65D 2251/04* (2013.01)

(58) Field of Classification Search

USPC ..... 215/382, 309, 329, 204, 205, 208, 211, 215/214.6, 11.4, 11.1, 6, 214; 220/691, 220/682, 690

See application file for complete search history.

(56) References Cited

U.S. PATENT DOCUMENTS

| | | | | | |
|---|---|---|---|---|---|
| 1,500,917 | A * | 7/1924 | Bell | B65D 7/24 | 220/4.09 |
| 1,852,281 | A * | 4/1932 | Bell | B65D 7/30 | 220/4.09 |
| 1,976,209 | A * | 10/1934 | Ashe | B65D 7/30 | 220/4.09 |
| 4,600,111 | A * | 7/1986 | Brown | A47G 19/2272 | 215/11.1 |
| 5,735,422 | A * | 4/1998 | Binter | B65D 21/0204 | 215/6 |
| 6,063,223 | A * | 5/2000 | Klauke | B65D 35/22 | 156/242 |
| 6,299,010 | B1 * | 10/2001 | Hsu | B65F 1/02 | 220/4.08 |
| 9,988,177 | B1 * | 6/2018 | Ruprecht | B65D 11/04 | |
| 2009/0266737 | A1 * | 10/2009 | Cole | A47G 19/2272 | 206/499 |
| 2013/0037426 | A1 * | 2/2013 | Shen | B65D 21/0204 | 206/216 |

* cited by examiner

*Primary Examiner* — J. Gregory Pickett
*Assistant Examiner* — Tia Cox

(57) ABSTRACT

The current invention is a bottle like a water bottle or baby bottle that can be broken up into pieces. It has top and bottom pieces with threads with a middle section separates into two or more sides that separate. The sides are arced and are connected at the edges. When the sides are connected they form a cylinder. The sides have threads on the top and bottom. The bottom screws on the bottom on the cylinder. The top has a spout and screws on the top of the cylinder.

6 Claims, 5 Drawing Sheets

RECYCLE BOTTLE WITH SPLIT ABLE MAIN BODY

CROSS-REFERENCES TO RELATED APPLICATIONS (IF ANY)

None.

BACKGROUND

1. Field of the Invention

This invention relates to bottles and particularly ones were the main body can be split up.

2. Description of Prior Art

People often want to fill their water bottles with drinks other than water but don't want to deal with the aftermath. People will fill their water bottle with a different drink and no matter how often they wash it afterwards, it still tastes like the other drink. Many time people just end up just throwing your water bottle away.

There is still room for improvement in the art.

SUMMARY OF THE INVENTION

The current invention is a bottle such as a water bottle, that can be broken up into pieces. It has top and bottom pieces with threads with a middle section separates into two or more sides that separate. The sides are arced and are connected at the edges. When the sides are connected they form a cylinder. The sides have threads on the top and bottom. The bottom screws on the bottom on the cylinder. The top has a spout and screws on the top of the cylinder.

BRIEF DESCRIPTION OF THE DRAWINGS

Without restricting the full scope of this invention, the preferred form of this invention is illustrated in the following drawings.

DESCRIPTION OF THE PREFERRED EMBODIMENT

Figure 1:
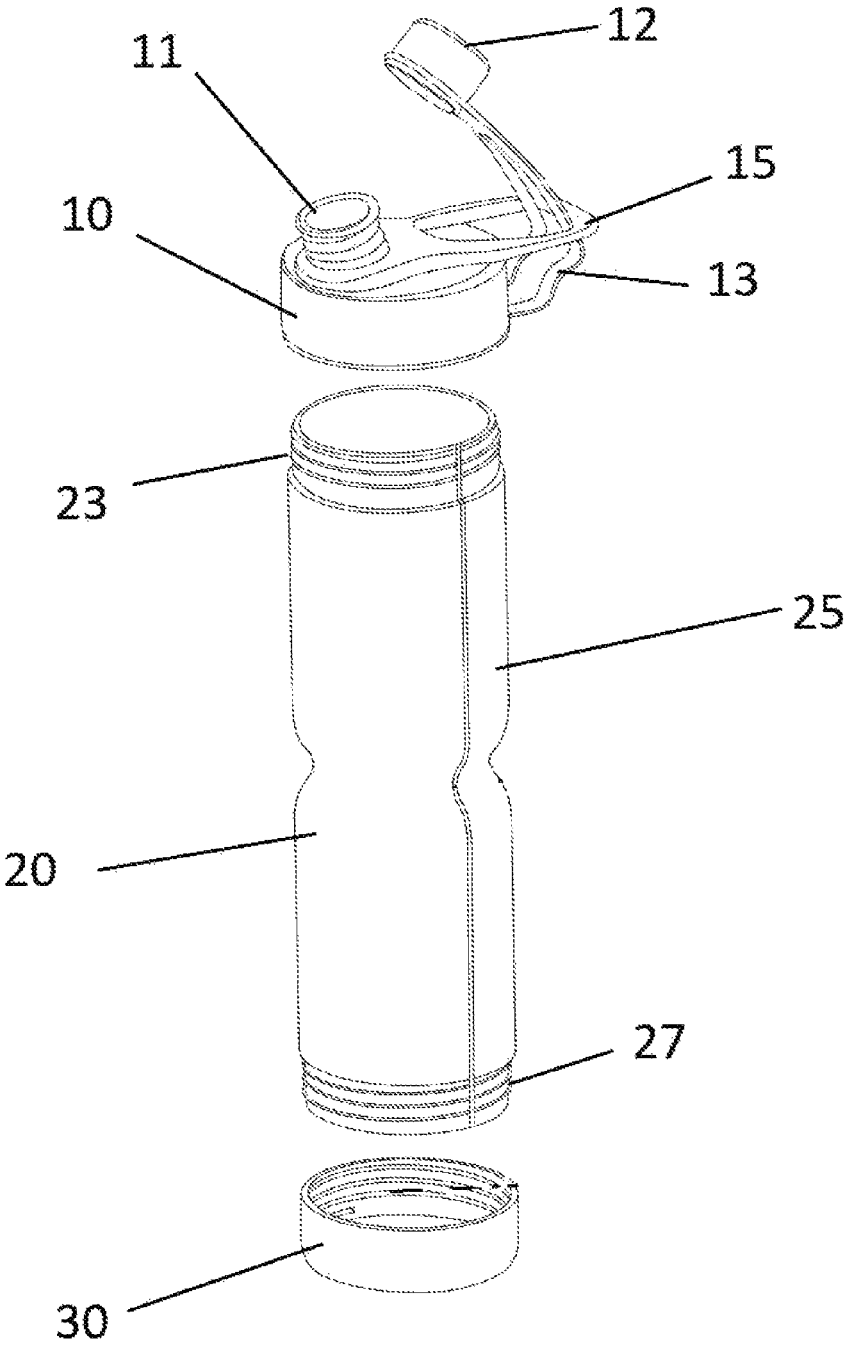
FIG. 1 shows a view of the bottle and its components.
Figure 2:
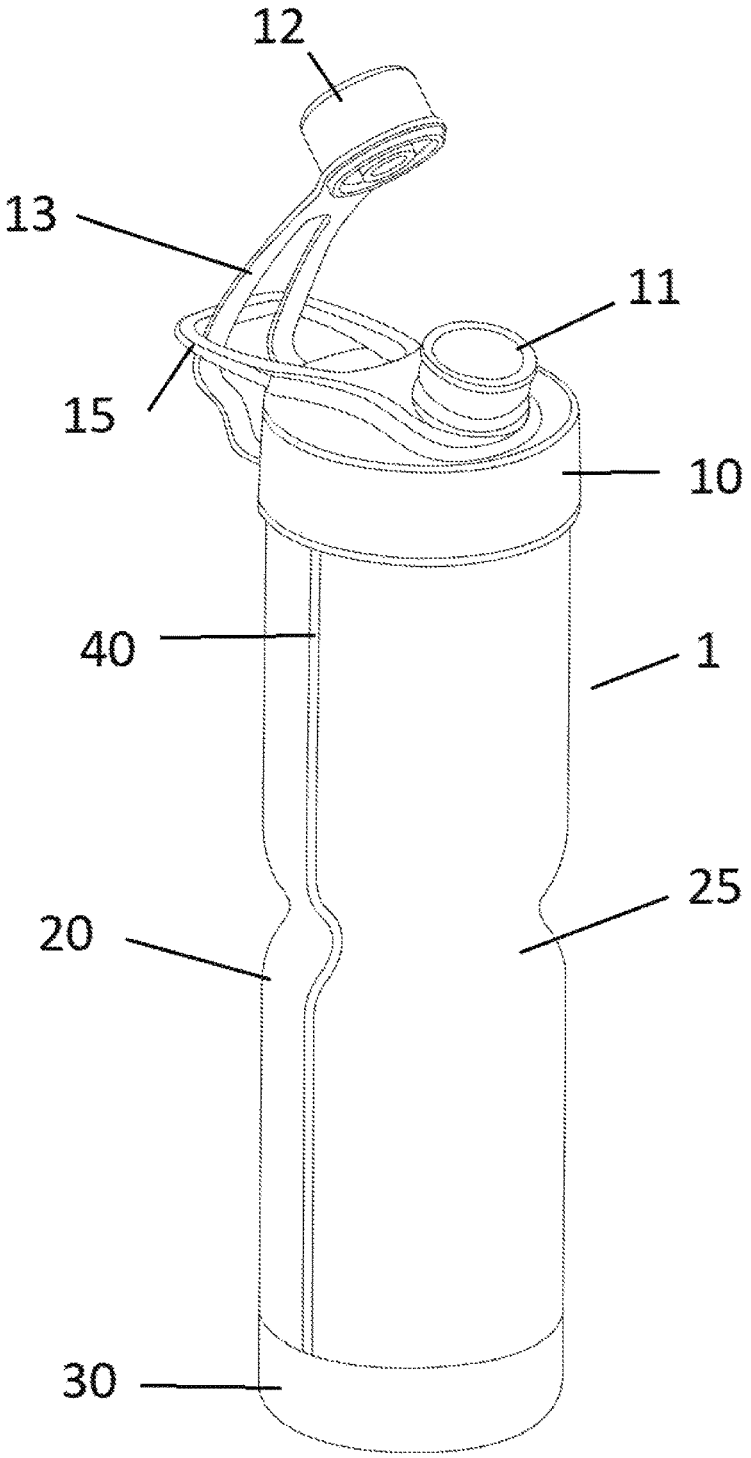
FIG. 2 shows a view of the water bottle.
Figure 3:
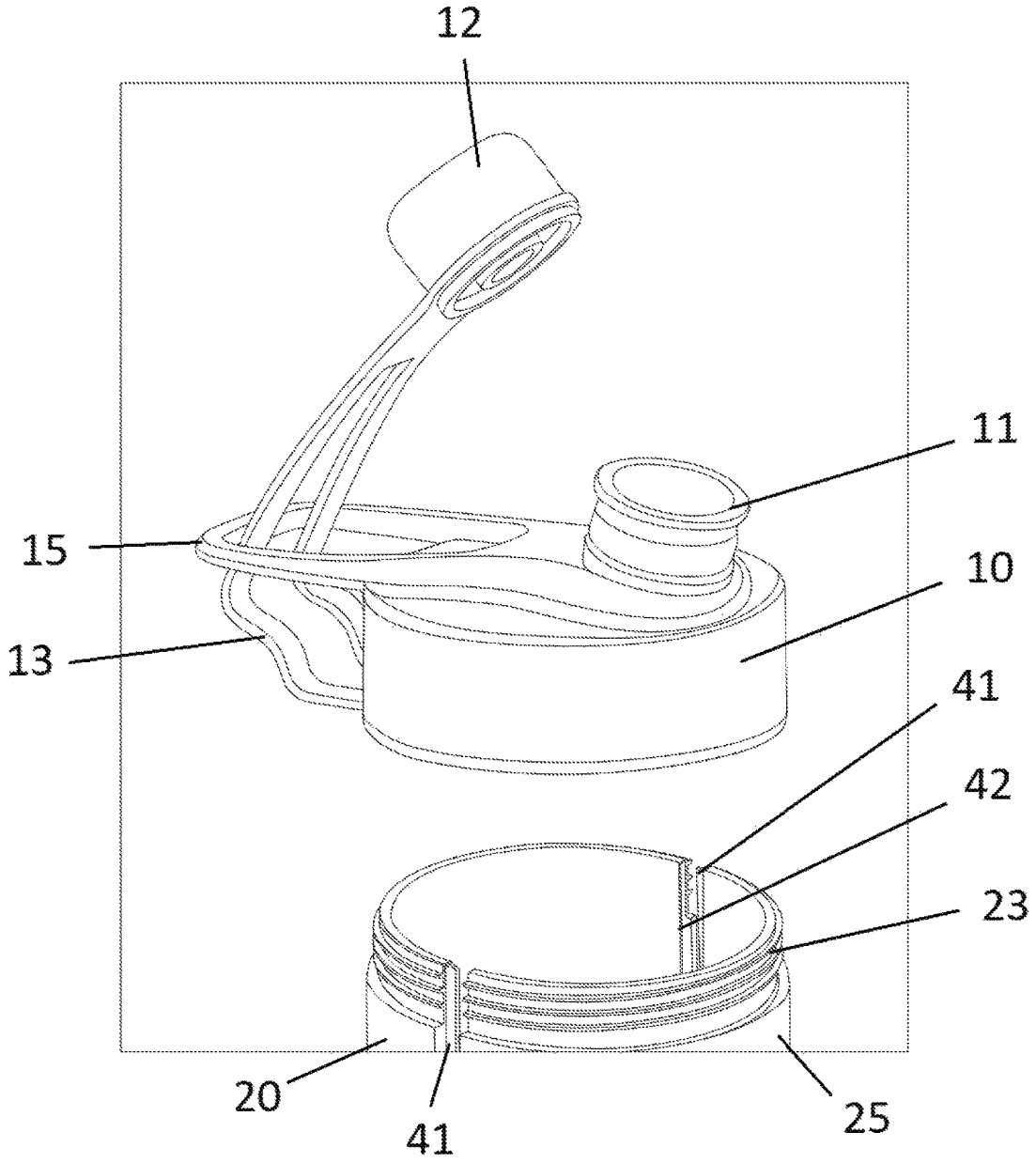
FIG. 3 shows the lid and the threads at the top of the sides.
Figure 4:
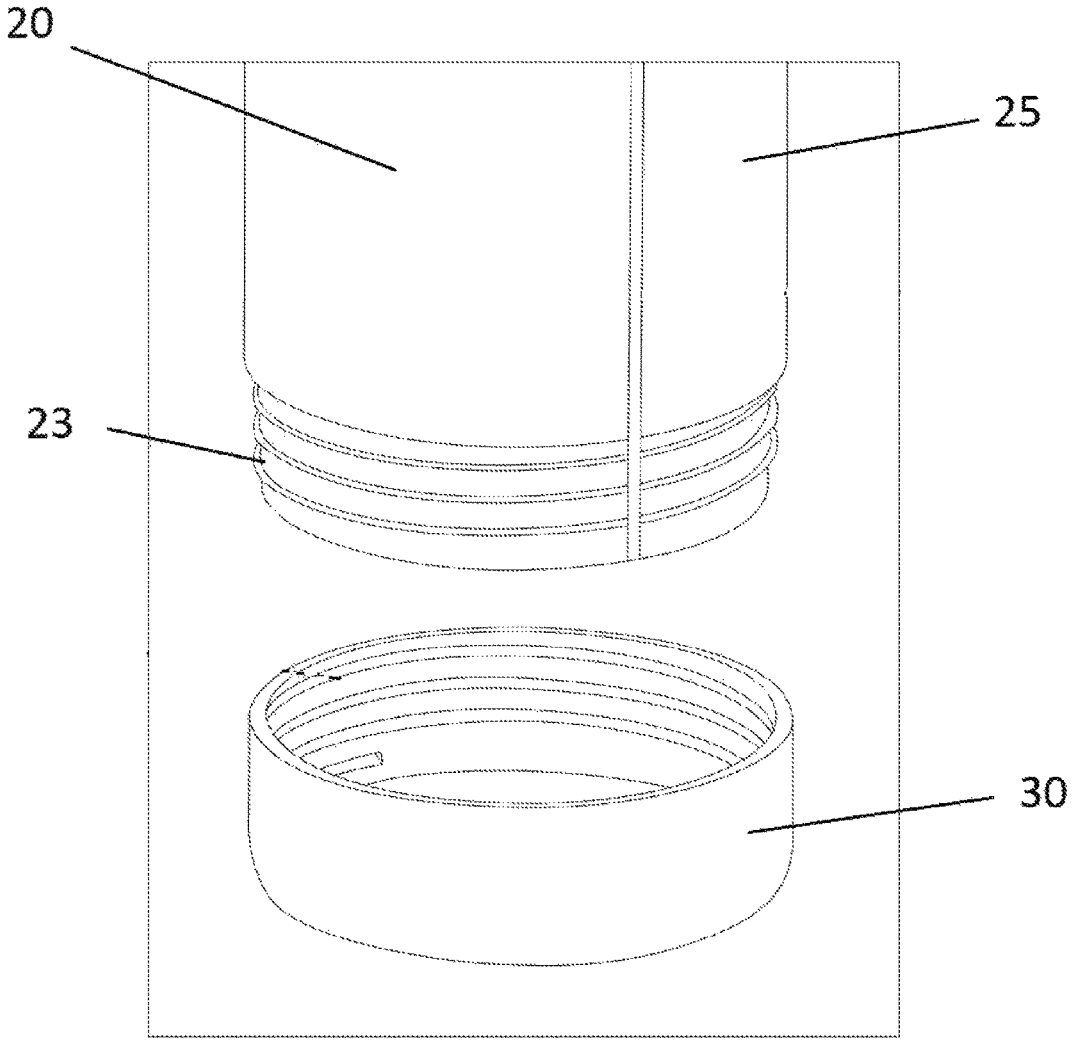
FIG. 4 shows the bottom threads and the threads at the bottle of the sides.

There are a number of significant design features and improvements incorporated within the invention.

As shown in FIGS. 1-5, the current invention is a bottle 1, such as a water bottle or baby bottle, that can be broken up into pieces. It has top 10 and bottom 20 pieces with threads with a middle section separates into two or more sides (20, 25) that separate. The sides (20, 25) are arced and are connected at the edges. When the sides are connected they form a cylinder. The sides have threads on the top and bottom. The bottom 30 screws on the threads 27 at bottom on the cylinder. The top 10 has a spout 11 and screws on the top of the cylinder on threads at the top of the cylinder 23.

The top 10 has a cap 12 for the spout 11 which closes forming a waterproof seal. The cap 12 is connected to the top 10 with a top tab 13. The top tab 13 is guided with a tab guide 15 which is a loop connected to the top to insure that the tab 13 is securely positioned.

Figure 5:
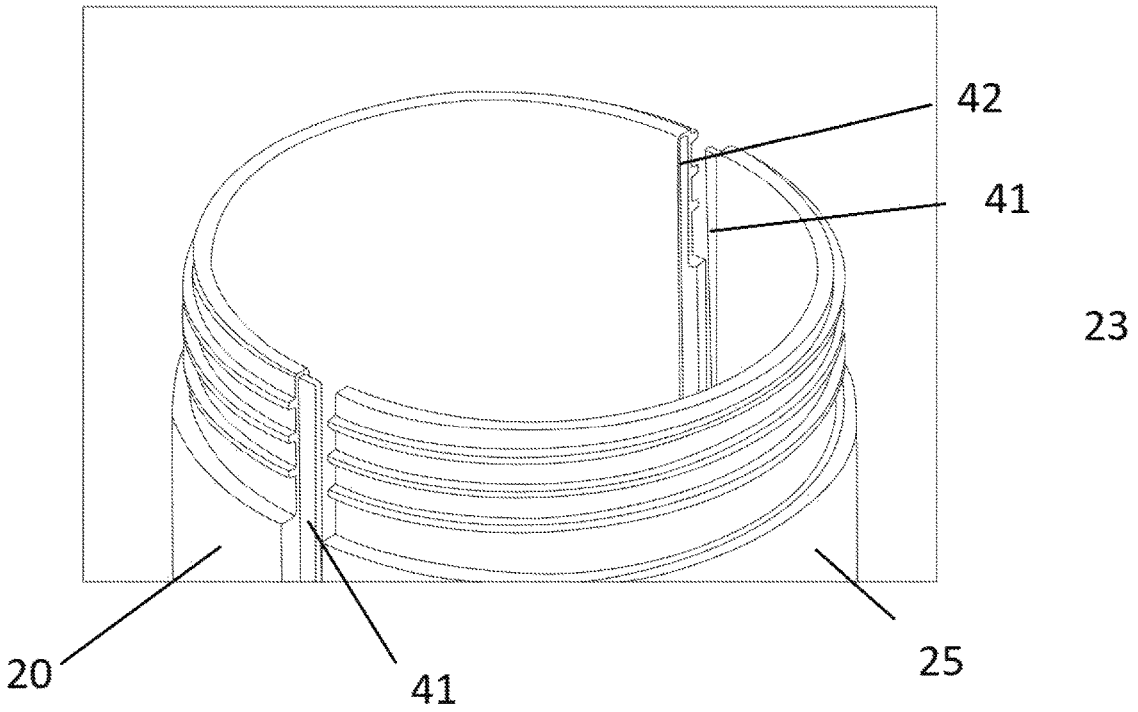
FIG. 5 is a closer view of the threads at the top of the bottle sides.

The sides (20, 25) connect together using a tongue 41 and grove 42 function with a waterproof fit as shown in FIG. 5. There are two sides in the preferred embodiment but more sides can be used.

Advantages

The current invention is:

Reusable—Stays clean so you never have to buy a new bottle.

Fresh and Clean—No left over germs or residue will be left.

Easy to Use—Simply twist and pull apart.

Mix It Up—Put in any beverage without fear of residual taste.

Although the present invention has been described in considerable detail with reference to certain preferred versions thereof, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

That which is claimed is:

1. A device comprising:

a bottle that has an attachable top and a bottom with a plurality of sides with a top and bottom that connect together to form a single liquid holding chamber where each side has one end with a tongue and another end with a groove where the tongue that runs along one end of the side fits into the groove that runs along the opposite end of another side where the sides have threads on the top and the bottom where the bottom has threads on its inside surface, where the top has threads on its inside surface where the bottom screws on the threads at bottom of the sides and the top screws on the threads at top of the sides.

2. A device according to claim 1 further comprising: Having two sides.

3. A device according to claim 1 further comprising: the top having a spout.

4. A device according to claim 3 further comprising: having a cap for the spout which closes forming a waterproof seal.

5. A device according to claim 3 further comprising: where the cap is connected to the top with a top tab.

6. A device according to claim 5 further comprising: where the top tab is guided with a tab guide.

* * * * *